US008232853B2

(12) United States Patent
Ryou et al.

(10) Patent No.: US 8,232,853 B2
(45) Date of Patent: Jul. 31, 2012

(54) TRANSMISSION LINE WITH LEFT-HAND CHARACTERISTICS INCLUDING A SPIRAL INDUCTIVE ELEMENT

(75) Inventors: Byung Hoon Ryou, Seoul (KR); Won Mo Sung, Siheung-si (KR); Myo Guen Yang, Incheon (KR); Jeong pyo Kim, Seoul (KR)

(73) Assignee: EMW Co., Ltd., Incheon (KR)

( * ) Notice: Subject to any disclaimer, the term of this patent is extended or adjusted under 35 U.S.C. 154(b) by 187 days.

(21) Appl. No.: 12/438,351

(22) PCT Filed: Aug. 22, 2007

(86) PCT No.: PCT/KR2007/004015

§ 371 (c)(1),
(2), (4) Date: Jul. 8, 2009

(87) PCT Pub. No.: WO2008/023931

PCT Pub. Date: Feb. 28, 2008

(65) Prior Publication Data

US 2010/0244999 A1 Sep. 30, 2010

(30) Foreign Application Priority Data

Aug. 22, 2006 (KR) ..... 10-2006-0079326

(51) Int. Cl.
*H01P 3/08* (2006.01)

(52) U.S. Cl. ..... 333/246; 333/185

(58) Field of Classification Search ..... 333/246, 333/238, 24 C, 1, 185
See application file for complete search history.

(56) References Cited

U.S. PATENT DOCUMENTS

| | | | | |
|---|---|---|---|---|
| 3,024,430 | A | 3/1962 | Zamites | |
| 3,784,937 | A * | 1/1974 | Jackson et al. | 333/24 C |
| 5,636,099 | A | 6/1997 | Sugawara et al. | |
| 5,929,729 | A | 7/1999 | Swarup | |
| 6,091,310 | A * | 7/2000 | Utsumi et al. | 333/12 |
| 6,170,154 | B1 | 1/2001 | Swarup | |
| 6,323,745 | B1 * | 11/2001 | Toncich | 333/204 |

(Continued)

FOREIGN PATENT DOCUMENTS

JP 1996-321705 A 3/1996

(Continued)

OTHER PUBLICATIONS

Christophe Caloz, et al., "A novel composite right-/left-handed coupled-line directional coupler with arbitrary coupling level and broad bandwidth," IEEE Transactions on Microwave Theory and Techniques, vol. 52, No. 3, pp. 980-992 (Mar. 2004).

(Continued)

*Primary Examiner* — Benny Lee
(74) *Attorney, Agent, or Firm* — The PL Law Group, PLLC

(57) ABSTRACT

The present invention relates to a transmission line in which a physical value of an inductive element can be changed in various ways while minimizing a size. The transmission line of the present invention includes a transmission unit, a ground unit and inductive elements. The inductive element connects the transmission unit and the ground unit, and has a predetermined pattern. The inductive element is provided between two surfaces of a substrate. According to the present invention, a physical value of the inductive element, in particular, an inductance value can be changed in various ways while not increasing an overall size. Accordingly, a transmission line can be designed freely according to its application.

1 Claim, 4 Drawing Sheets

U.S. PATENT DOCUMENTS

| | | | | |
|---|---|---|---|---|
| 6,448,873 | B1 | 9/2002 | Mostov | |
| 6,518,864 | B1 * | 2/2003 | Ito et al. | 333/238 |
| 6,720,849 | B2 * | 4/2004 | Sasaki et al. | 333/204 |
| 6,825,734 | B2 | 11/2004 | Clark | |
| 6,958,729 | B1 | 10/2005 | Metz | |
| 6,970,055 | B2 | 11/2005 | Toncich | |
| 7,071,797 | B2 | 7/2006 | Ye | |
| 7,190,014 | B2 | 3/2007 | Kao | |
| 7,330,090 | B2 | 2/2008 | Itoh et al. | |
| 2001/0017582 | A1 | 8/2001 | Sakata | |
| 2006/0066422 | A1 | 3/2006 | Itoh et al. | |
| 2006/0086963 | A1 | 4/2006 | Wu | |

FOREIGN PATENT DOCUMENTS

| | | | |
|---|---|---|---|
| JR | 2001-077538 | A | 3/2001 |
| JR | 2002-151908 | A | 5/2002 |
| KR | 10-2003-0071059 | | 9/2003 |
| KR | 20050081546 | A | 8/2005 |
| KR | 100802358 | B1 | 2/2008 |
| WO | WO 2005-084090 | A | 9/2005 |
| WO | WO 2008/054108 | A1 | 5/2008 |

OTHER PUBLICATIONS

International Search Report for PCT/KR2007/004015, 2 pgs. (Nov. 29, 2007).

First Office Action pertaining to corresponding JP application No. 2009-524563, dated Oct. 6, 2010, 3 pages.

First Office Action pertaining to corresponding EP application No. 07793619,3, dated Apr. 4, 2010, 6 pages.

Staiculescu et al., "Multilayer Embedded Metamaterial Optimization for 3D Integrated Module Applications", Antennas and Propagation Society International Symposium 2006, IEEE Albuquerque, NM, USA Jul. 9-14, 2006, Piscataway, NJ, USA, IEEE, Jan. 1, 2006, pp. 4137-4140.

Caloz et al., "Super-Compact Multilayered Left-Handed Transmission Line and Diplexer Application", IEEE Transactions on Microwave Theory and Techniques, IEEE Service Center, Piscataway, NJ, US, vol. 53, No. 4, Apr. 1, 2005, pp. 1527-1534.

Horii et al., "Vertical multi-layered implementation of a purely left-handed transmission line for super-compact and dual-band devices", Microwave Conference, 2004, Piscataway, NJ, USA, IEEE, vol. 1, Oct. 11, 2004, pp. 471-473.

Yang et al., "Characteristics of Microstrip Lines through a Metalized EBG Substrate", Microwave Symposium Digest, 2006 IEEE MTT-S International, IEEE, PI, Jun. 1, 2006, pp. 1655-1658.

Hoffmann, Reinmut K., "Circuit Components for Microstrip Circuits", Handbook of Microwave Integrated Circuits, pp. 91-93, (1987).

Jinghong Chen, et al., "Design and Modeling of a Micromachined High-QTunable Capacitor with Large Tuning Range and a Vertical Planar Spiral Inductor", IEEE Transactions on Electron Devices, vol. 50, No. 3, pp. 730-739, (Mar. 2003).

Ju-Ho Son, et al., "Design of the Bluetooth Negative Resistor Oscillator using the Improved Spiral Inductor", Multimedia Academy, pp. 325-331, (Apr. 2003).

* cited by examiner

[Fig. 1]
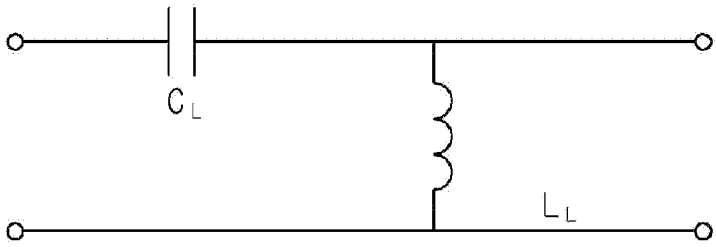
[Fig. 2]
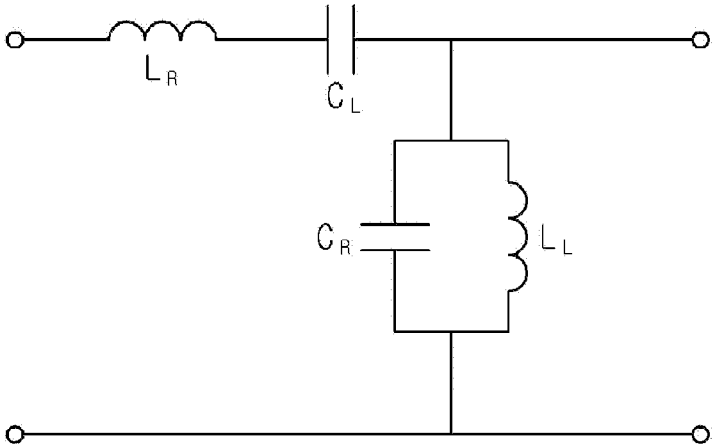
[Fig. 3] PRIOR ART
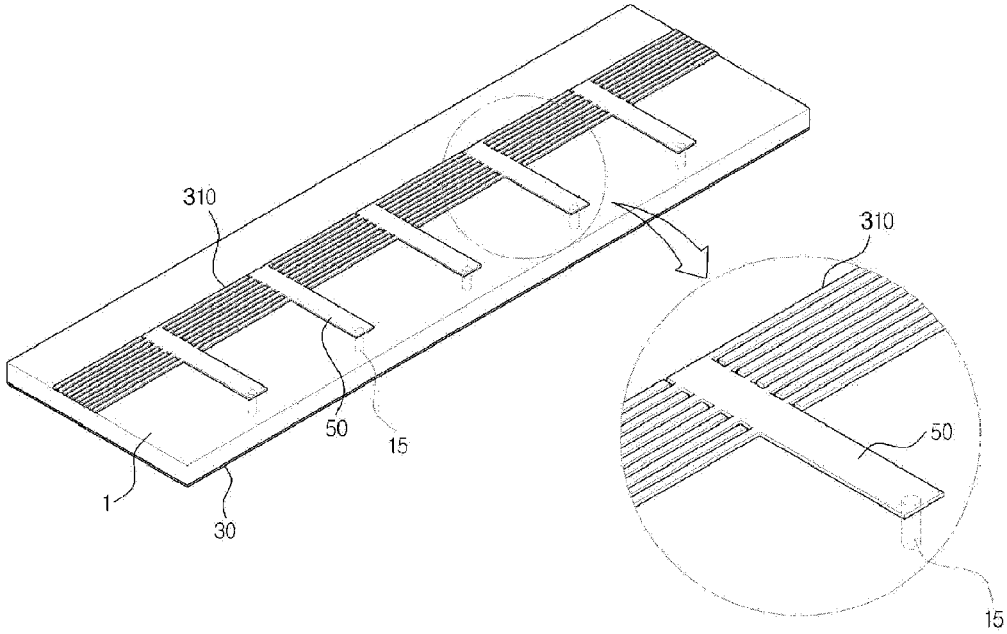

[Fig. 4]
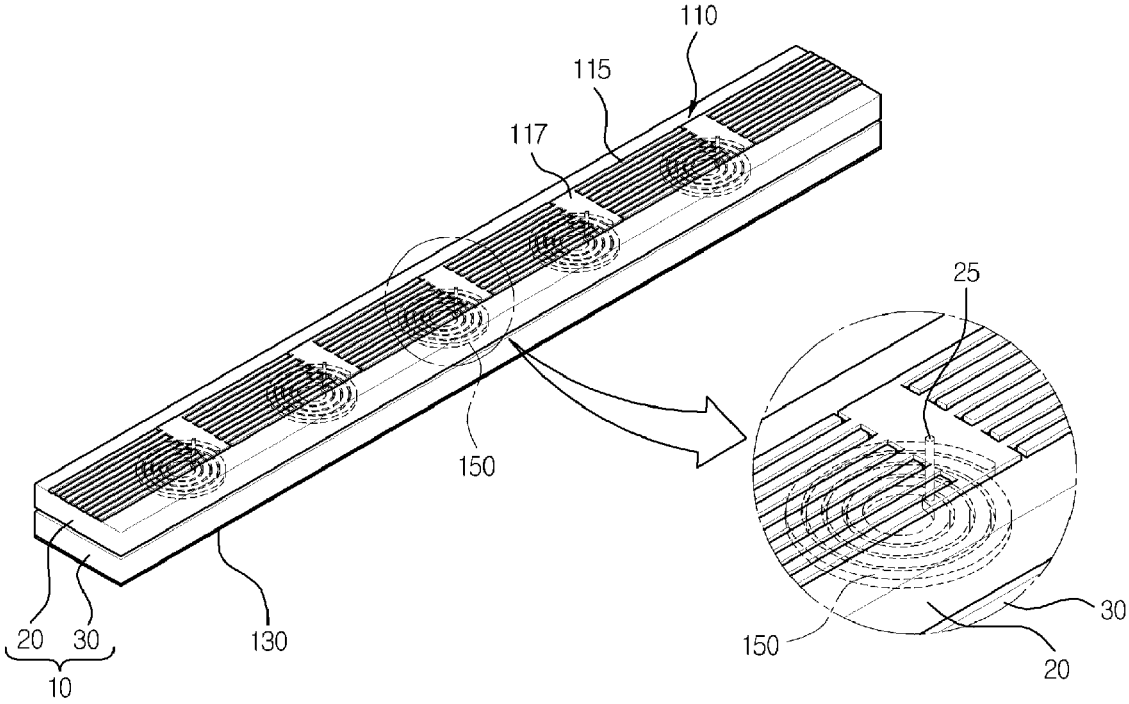
[Fig. 5]
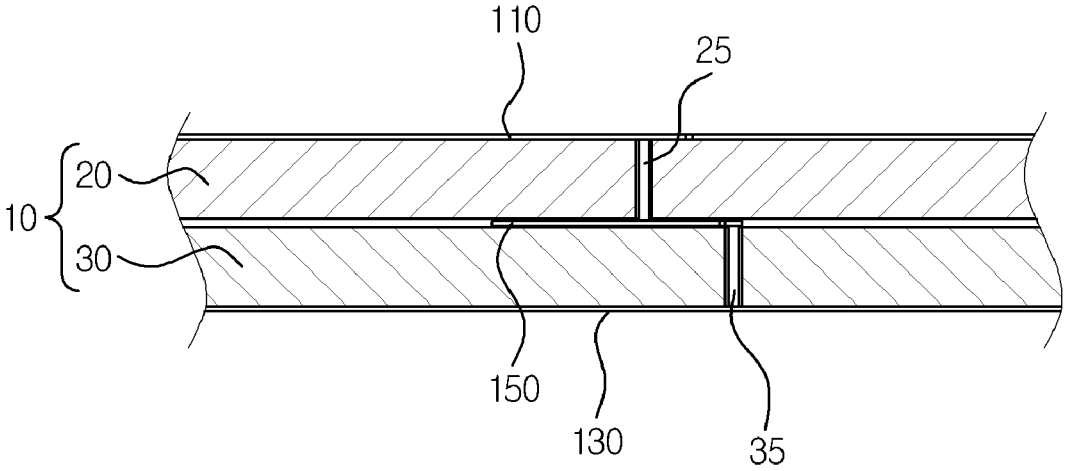

[Fig. 6]
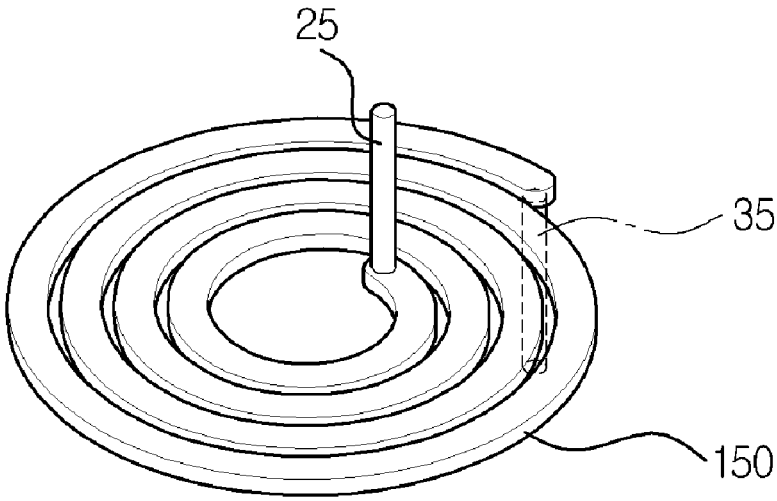
[Fig. 7]
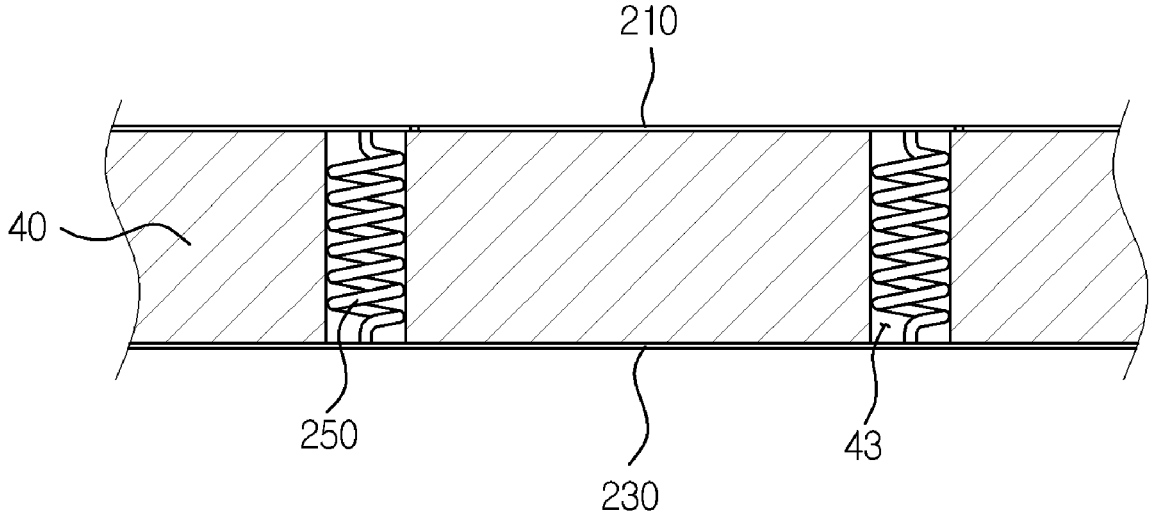

[Fig. 8]
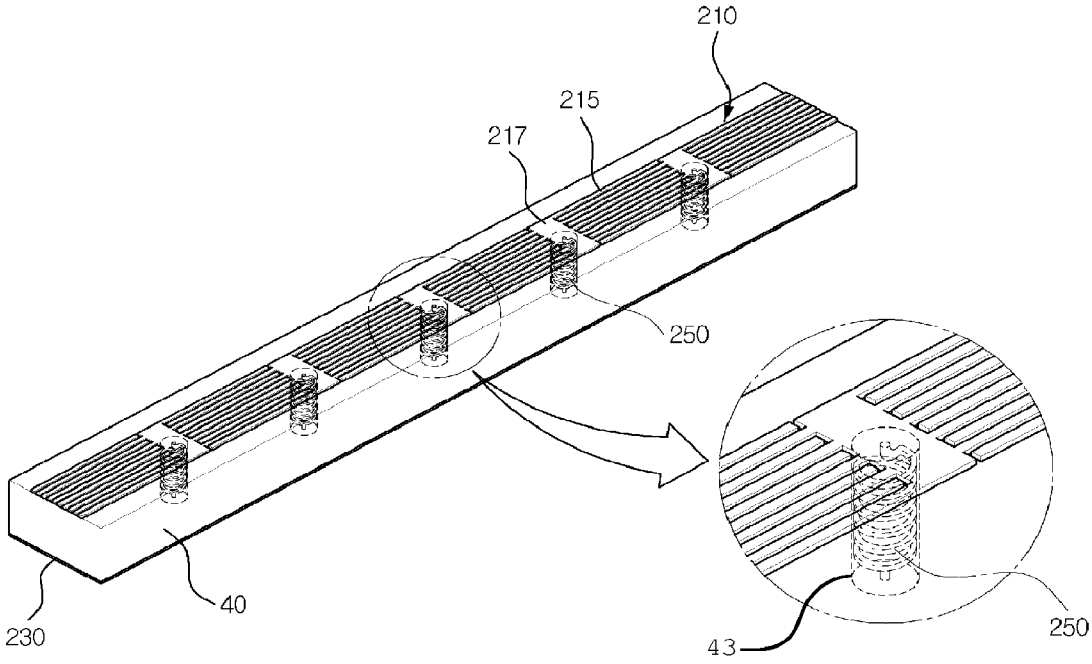

TRANSMISSION LINE WITH LEFT-HAND CHARACTERISTICS INCLUDING A SPIRAL INDUCTIVE ELEMENT

CROSS REFERENCE TO RELATED APPLICATIONS

This patent application is a U.S. National Phase application under 35 U.S.C. §371 of International Application No. PCT/KR2007/004015, filed on Aug. 22, 2007, entitled TRANSMISSION LINE, which claims priority to Korean patent application number 10-2006-0079326, filed Aug. 22, 2006.

FIELD

The present invention relates to a transmission line, and more particularly, to a transmission line which enables various modifications of physical values of inductive elements and miniaturization of a device through the improvement of a structure.

BACKGROUND

In general, a transmission line refers to a conductor system consisting of several conductors, and employing a propagation operation of a wave by electrical parameters, which are distributed between conductors, for example, such as resistance, inductance, conductance, and capacitance per unit length.

Recently, active research has been conducted on methods of implementing a Left-Handed (LH) characteristic by employing this transmission line. The LH characteristic refers to a characteristic in which the propagation directions of an electric field, a magnetic field, and electromagnetic waves comply with Fleming's left hand rule contrary to Fleming's right hand rule, and is related with a theory of artificial "metamaterial." The term "metamaterial" generally refers to a material, which is synthesized by an artificial method so as to exhibit special electromagnetic properties that can be seen rarely in the natural world.

A construction of the transmission line having the LH characteristic will be described below with reference to FIGS. 1 and 2. While a typical transmission line equivalent model is represented by an equivalent circuit of a serial inductor and a parallel capacitor, in a transmission line structure comprising a serial capacitor $C_L$ and a parallel inductor $L_L$, in which the positions of the serial inductor and the parallel capacitor are exchanged, as illustrated in FIG. 1, there occurs a phenomenon in which the phase velocity of electromagnetic waves transmitted through the transmission line structure is reversed.

FIG. 1 shows an equivalent circuit of the transmission line having the serial capacitor and the parallel inductor. In this transmission line, when a phase velocity and a group velocity are calculated, a LH propagation characteristic is obtained in which the phase and group velocities are oriented in opposite directions.

Meanwhile, a more general structure in which a transmission line (hereinafter, referred to as a 'RH transmission line') representing a Right-Handed (RH) characteristic and a transmission line (hereinafter, referred to as a 'LH transmission line') representing a LH characteristic are integrated has been known as a transmission line (hereinafter, referred to as a 'CRLH transmission line') representing a Composite Right/Left Handed (CRLH) characteristic. An equivalent circuit of a CRLH transmission line is shown in FIG. 2.

The structure arranged as shown in FIG. 2 has the characteristic of the LH or RH transmission line depending on whether the influence of any one of the inductor and the capacitor of a serial connection unit and a parallel connection unit is significant in a specific frequency band.

The structure has a stopband characteristic at a resonant frequency of the serial unit and the parallel unit. This fact can be easily confirmed in the transmission characteristic of the general CRLH transmission line shown in FIG. 2. In more detail, at a low frequency band, the LH transmission characteristic mainly appears due to the action of a serial capacitor $C_L$ and a parallel inductor $L_L$, whereas at a high frequency band, the RH transmission characteristic mainly appears due to the action of a serial inductor $L_R$ and a parallel capacitor $C_R$. A stopband of electromagnetic waves exists between the two regions.

A construction of a transmission line in which the CRLH transmission line model is implemented actually will be described below with reference to FIG. 3.

In an actual implementation, each inductor and each capacitor can be implemented as a concentrated constant circuit by mounting a capacitive element and an inductive element of a Surface Mount Device (SMD) chip type or as distributed constant circuit by forming an IDT (interdigital) capacitive element and an inductive element on a circuit pattern.

FIG. 3 shows an example of a conventional CRLH transmission line constructed by forming an IDT capacitive element and an IDT inductive element on a circuit pattern.

The conventional transmission line largely includes capacitive elements 310, inductive elements 50 and a ground unit 30.

The capacitive elements 310 have an IDT pattern and are arranged at predetermined intervals in the length direction. The inductive elements 50 are formed on the same plane as that of the capacitive element 310, and have a stub shape projecting between the capacitive elements 310 in a lateral direction.

The ground unit 30 has a ground surface form provided on the other side of a substrate 1, and is electrically connected to one ends of the inductive elements by conductive connection elements 15. The connection elements 15 can be formed through via holes penetrating both surfaces of the substrate 1.

The serial capacitor $C_L$ FIG. 2 is formed by the capacitive element 310 having the IDT pattern, and the parallel inductor $L_L$ FIG. 2 is formed by the inductive element 50 whose ends are shorted.

A parasitic capacitive component between an IDT structure and a ground surface forms the parallel capacitor $C_R$ of FIG. 2. The serial inductor $L_R$ of FIG. 2 is formed by current existing on the IDT pattern and entire structure operates as the CRLH transmission line.

However, the above conventional transmission line has the following problems.

The value of the serial capacitor can vary by controlling an detailed shape of IDT, a distance between the elements and so on, but has many limitations in changing an inductance value in the inductor. In other words, in order to increase the inductance, the length of the inductive element projecting in a lateral direction on the same plane as that of the capacitive element must be increased. Accordingly, there was a problem in that the width of the substrate increases, resulting in an increase of the overall size of a device.

Meanwhile, unlike the above method, the inductive element can be formed from a conductive material formed in the via hole between the substrates. In this case, however, there was a problem in that the inductance value could not be changed according to a design condition since the width, material, etc. of the substrate are defined.

SUMMARY OF THE INVENTION

Accordingly, the present invention has been made in view of the above problems occurring in the prior art, and an object of the present invention is to provide a transmission line which can miniaturize a device and can increase an inductance value through improvement of a structure.

Another object of the present invention is to provide a transmission line whose shape can be designed freely in order to actively cope with required conditions.

To achieve the above objects, the present invention provides a transmission line, including a conductive transmission unit formed on one surface of a substrate and adapted to transmit an electrical signal, a ground unit formed on the other surface of the substrate, and an inductive element formed to have a predetermined pattern between two surfaces of the substrate and adapted to interconnect the transmission unit and the ground unit so as to ground the transmission unit.

The transmission unit includes one or more capacitive elements disposed at predetermined intervals in the length direction. The capacitive element has an IDT-shaped pattern.

Meanwhile, the inductive element includes a helical element extending upwardly and downwardly between the surfaces of the substrate. And the substrate is formed in plural, and the inductive element is formed on a junction surface between the plurality of substrates.

Furthermore, the inductive element includes a spiral-shaped element. The inductive element is connected to the transmission unit or the ground unit by means of conductive connection element, and the connection element has a helical shape.

The transmission line according to the present invention as constructed above has the following advantages.

First, the inductive elements are provided between both surfaces of the substrate. Accordingly, there is a benefit in that an inductance value can be changed in various ways. That is, a device can be miniaturized since a space utilization degree of the transmission line is increased. Further, an inductance value can be increased while minimizing the size of the transmission line.

Second, there is a benefit in that a transmission line can be designed actively in line with a desired frequency band according to a desired condition. In more detail, an inductance value to meet a desired design condition can be implemented by modifying the shape of the inductive elements provided between both surfaces of the substrate in various ways.

BRIEF DESCRIPTION OF THE DRAWINGS

Further objects and advantages of the invention can be more fully understood from the following detailed description taken in conjunction with the accompanying drawings in which:

FIG. 1 is a circuit diagram showing an equivalent circuit of a general LH transmission line;

FIG. 2 is a circuit diagram showing an equivalent circuit of a general CRLH transmission line;

FIG. 3 is a perspective view showing a construction of a conventional CRLH transmission line;

FIG. 4 is a perspective view schematically illustrating a transmission line according to a first embodiment of the present invention;

FIG. 5 is a lateral view of FIG. 4;

FIG. 6 is a perspective view illustrating an inductive element and a connection element of FIG. 4;

FIG. 7 is a perspective view schematically illustrating a transmission line according to a second embodiment of the present invention; and FIG. 8 is a lateral view of FIG. 7.

DETAILED DESCRIPTION OF THE EMBODIMENTS

The present invention will now be described in detail in connection with specific embodiments with reference to the accompanying drawings.

A construction of a transmission line according to a first embodiment of the present invention will be described below with reference to FIGS. 4 to 6.

FIG. 4 is a perspective view schematically illustrating a transmission line according to a first embodiment of the present invention. FIG. 5 is a lateral view of FIG. 4. FIG. 6 is a perspective view illustrating an inductive element and a connection element of FIG. 4.

The transmission line in accordance with the present embodiment largely includes a transmission unit 110, a ground unit 130, and inductive elements 150, as shown in FIGS. 4 and 5.

As illustrated in FIGS. 4 and 5, the transmission unit 110 is provided on one surface of the substrate 10, and transmits an electrical signal. The substrate 10 can be preferably formed from a dielectric material having an insulating property. The transmission unit 110 can be formed from a thin metal element on the substrate 10 or can be formed by coating a conductive material on the substrate 10 by a method such as etching.

Meanwhile, as shown in FIG. 4, the transmission unit 110 includes capacitive elements 115 and stubs 117 that are repetitively arranged in the length direction.

In the present embodiment, the capacitive elements 115 have elements of an IDT pattern in such a manner that the elements are geared with each other at predetermined intervals as shown FIG. 4. The stub 117 is provided between the capacitive elements 115, and is electrically connected to the inductive element 150 by a first connection element 25, as shown in FIGS. 4-6 and to be described later on.

The ground unit 130 is provided on the other surface of the substrate 10, and is connected to the transmission unit 110 via the inductive element 150. The ground unit 130 functions to ground the transmission unit 110. In the present embodiment, the ground unit 130 has a ground surface form formed on the bottom of the substrate 10.

The inductive element 150 is provided between both surfaces of the substrate 10, and has a predetermined pattern and a constant inductance value.

Meanwhile, in the present embodiment, the substrate 10 includes a first substrate 20, and a second substrate 30 adhered under the first substrate 20. The transmission unit 110 is provided on the top surface of the first substrate 20 and the ground unit 130 is provided on the bottom surface of the second substrate 30, as shown in FIGS. 4 and 5.

The inductive element 150 has a thin film shape of a thin thickness in the longitudinal direction, and is provided on the junction surface of the first substrate 20 and the second substrate 30.

The inductive element 150 is not limited to the above shape, but may be changed according to various design conditions. The present embodiment illustrates a shape having a spiral-shaped element as shown in FIG. 6. In this case, an inductance value can be changed by controlling the size, distance, etc. of the spiral-shaped element.

The inductive element 150 is electrically connected to the transmission unit 110 and the ground unit 130 by conductive connection elements 25 (FIGS. 4-6) and 35 (FIGS. 5-6). The substrate 10 has both surface penetrated through via holes. The conductive connection elements 25 and 35 are provided within the via holes, enabling electrical connection between the elements.

In more detail, the inductive element 150 and the transmission unit 110 are electrically connected to each other by the first connection element 25 provided in the first substrate 20, and the inductive element 150 and the ground unit 130 are electrically connected to each other by the second connection element 35 provided in the second substrate 30.

The first and second connection elements 25 and 35 are not limited to the above shapes. In the present embodiment, it has been illustrated that the connection elements 25 and 35 have a cylindrical shape formed from a conductive material as shown in FIG. 6. Further, the inductive element 150 and the connection elements 25 and 35 can be formed integrally, or can be formed separately and then combined together.

In the transmission line constructed above, a serial capacitor $C_L$ is formed by the capacitive element 115 having the IDT pattern, and the parallel inductor $L_L$ is formed by the inductive element 150 provided between both surfaces of the substrate 10.

Furthermore, a parasitic capacitive component between the capacitive element 115 of the IDT pattern and the ground surface forms a parallel capacitor $C_R$, and a serial inductor $L_R$ is generated by current existing on the IDT pattern. Thus, the transmission line operates as a CRLH transmission line structure entirely.

Meanwhile, in the present embodiment, it has been illustrated that the two substrates 10 are joined together and the inductive element 150 is provided on the junction surface of the two substrates 10. However, unlike the above construction, the transmission line may be constructed in such a manner that three or more substrates 10 are joined together and the inductive element 150 is provided on at least one of plural junction surfaces formed between the substrates 10.

In this case, the number of the inductive element 150 is one or more, and between-respective elements can be electrically connected by connection elements provided within the via holes of the substrate 10.

A construction of a transmission line according to a second embodiment of the present invention will be described below with reference to FIGS. 7 and 8.

The present embodiment basically includes a transmission unit 210, a ground unit 230, and inductive elements 250 as in the first embodiment. The transmission unit 210 includes a capacitive element 215 and a stub 217, which are repeated, as shown in FIG. 8.

In contrast to the embodiment described with reference to FIGS. 4-6, in the embodiment illustrated in FIGS. 7 and 8, the inductive element 250 is formed to have a predetermined pattern within via holes 43 in the substrate 40.

In other words, as shown in FIG. 7, the top and bottom of the substrate 40 are both penetrated by the via holes 43, and the inductive elements 250 are formed in a predetermined pattern within the via holes 43.

The inductive element 250 is not limited to the above pattern shape. FIGS. 7 and 8 illustrate a shape in which the inductive element 250 has a helical element and extends up and down.

The inductive element 250 has one end electrically connected to a stub 217 of the transmission unit 210 and the other end electrically connected to a ground unit 230 formed on a bottom surface of the substrate 40.

Meanwhile, the transmission line can be constructed by combining the first and second embodiments. That is, in the substrate 40 in which a plurality of substrates are joined together, the transmission line can be constructed in such a manner that the inductive element 250 is provided between the junction surfaces of the substrate 40 and each connection element has a helical-shaped inductive element 250.

Although the specific embodiments of the present invention have been disclosed for illustrative purposes, those skilled in the art will appreciate that various modifications, additions and substitutions are possible, without departing from the scope and spirit of the invention as disclosed in the accompanying claims.

The transmission line having a LH characteristic has been described as an example so far. However, the invention is not limited to the disclosed embodiments, but may be universally applied to transmission lines having various shapes for forming a serial capacitor and a parallel inductor.

What is claimed is:

1. A transmission line, comprising:

a conductive transmission unit formed on a first surface of a substrate and adapted to transmit an electrical signal;

a ground unit formed on a second surface of the substrate; and an inductive element formed to have a predetermined pattern between the first and second surfaces of the substrate and adapted to interconnect the transmission unit and the ground unit so as to ground the transmission unit, wherein the inductive element comprises a spiral-shaped element.

* * * * *